US006094842A

United States Patent [19]

Borel

[11] Patent Number: 6,094,842

[45] **Date of Patent: *Aug. 1, 2000**

[54] SPORTS BOOT HAVING A MOBILE COLLAR

[75] Inventor: Rene Borel, Cran-Gevrier, France

[73] Assignee: Salomon S.A., Metz-Tessy, France

[ * ] Notice: This patent is subject to a terminal disclaimer.

[21] Appl. No.: 09/304,112

[22] Filed: May 4, 1999

Related U.S. Application Data

[63] Continuation of application No. 08/965,159, Nov. 6, 1997, Pat. No. 5,926,979.

[30] Foreign Application Priority Data

Nov. 8, 1996 [FR] France ..... 96.13854

[51] Int. Cl.[7] ..... A43B 5/00

[52] U.S. Cl. ..... 36/115; 36/118.3; 36/119.1

[58] Field of Search ..... 36/115, 118.2, 36/118.3, 118.4, 119.1

[56] References Cited

U.S. PATENT DOCUMENTS

| | | | |
|---|---|---|---|
| 3,067,531 | 12/1962 | Scott et al. | 36/118.2 |
| 4,602,443 | 7/1986 | Spademan | 36/118.4 |
| 4,615,128 | 10/1986 | Borsoi | 36/120 |
| 4,769,930 | 9/1988 | Morell et al. | 36/118.2 |
| 5,216,826 | 6/1993 | Chaigne et al. | 36/118.3 |
| 5,329,707 | 7/1994 | Chaigne et al. | 36/118.4 |
| 5,926,979 | 7/1999 | Borel | 36/118.3 |

FOREIGN PATENT DOCUMENTS

| | | | |
|---|---|---|---|
| 0150800 | 8/1985 | European Pat. Off. . | |
| 0406212 | 1/1991 | European Pat. Off. . | |
| 0467142 | 1/1992 | European Pat. Off. | 36/118.3 |
| 2433311 | 3/1980 | France | 36/118.2 |
| 3706085 | 9/1987 | Germany | 36/118.2 |

*Primary Examiner*—Marie Patterson
*Attorney, Agent, or Firm*—Greenblum & Bernstein, P.L.C.

[57] ABSTRACT

A sports boot of the type that includes a rigid frame constituted by at least one heel reinforcement and a rigid collar for the retention of the lower part of the leg connected to the heel reinforcement for forward and rearward angular movement, the angular movement of the collar being unimpeded at least forwardly when the sport is practiced. The transverse inclination device is associated to at least one portion of the collar, and an elastic return structure is associated to the transverse inclination device for a return into the neutral position.

22 Claims, 5 Drawing Sheets

SPORTS BOOT HAVING A MOBILE COLLAR

CROSS-REFERENCE TO RELATED APPLICATIONS

This application is a continuation of application Ser. No. 08/965,159, filed on Nov. 6, 1997, now U.S. Pat. No. 5,926,979, the disclosure of which is hereby incorporated by reference thereto in its entirety and the priority of which is claimed under 35 USC 120.

This application is also based upon French application No. 96.13854, filed on Nov. 8, 1996, the disclosure of which is hereby incorporated by reference thereto in its entirety and priority of which is hereby claimed under 35 USC 119.

BACKGROUND OF THE INVENTION

1. Field of the Invention

The instant invention is related to a sports boot specifically adapted for sports that require a substantial mobility for the foot with respect to the leg for bending/extending movements, while also requiring a good retention of the ankle in the transverse direction.

2. Description of Background and Relevant Information

Sports of the above-mentioned type particularly include, although not exclusively, roller skating, and especially in-line roller skating, cross-country skiing, walking/hiking, snowboarding, and wake boarding, etc.

Presently known, especially with respect to the fields of skating, cross-country skiing, and walking, is a boot construction having a rigid frame constituted of a shell, at least one heel reinforcement, and a mobile rigid collar journalled about a substantially transverse axis on the heel reinforcement and surrounding the lower part of the athlete's foot.

Such a collar can pivot towards the front and towards the rear about its transverse journal axis, possibly against elastic means, and thus provide total freedom of movement, especially in the forward bending of the leg with respect to the foot.

The emergence of new, extreme practices in these sports, such as the practice known as "aggressive" in in-line roller skating and "free ride" in snowboarding, generates new requirements. Indeed, in these extreme practices, the athlete wants above all to execute jumps and acrobatic figures, and this requires a substantial transverse inclination of the ankle, both on the inner side as well as the outer side.

Thus, the problem consists of providing a sports boot that allows these contradictory requirements to be fulfilled, i.e., lateral or transverse retention of the ankle and a certain mobility in the same transverse direction, while still retaining the desired front/rear mobility for the ankle with respect to the foot.

SUMMARY OF THE INVENTION

The aforementioned goal is achieved in the sports boot according to the invention, which is of the above-cited type, or, in other words, comprising a rigid frame constituted of at least one heel reinforcement and a rigid collar journalled along a substantially transverse axis on the heel reinforcement and surrounding the lower part of the athlete's leg, by the fact that the transverse inclination means are associated to at least one part of the collar, and the fact that the elastic return means are associated to the transverse inclination means for a return into the neutral position.

Such a construction enables the problem posed to be resolved, by allowing the desired clearance for the ankle in the transverse direction, while at the same time enabling it to retain a permanent "reference" or, in other words, an elastic return memory, such "reference" playing an important role in the retention of the ankle, by using the proprioceptive qualities of the lower part of the user's leg.

The two contradictory requirements of mobility and retention in the transverse direction are thus met.

A variety of constructions can be designed for the collar. As such, the desired transverse clearance can be obtained by obtaining on the collar, in the appropriate areas of the transverse deformation zones, elastic return means, which, in this case, would be constituted of the same material as the collar. This transverse clearance can also be obtained by an appropriate clearance in the area of the journal axes of the collar with the associated elastic return means.

BRIEF DESCRIPTION OF THE DRAWINGS

The invention will be better understood and other characteristics thereof will become more apparent with the help of the following description, with reference to the annexed schematic drawings, which represent, as non-restrictive examples, several preferred embodiments wherein.

DETAILED DESCRIPTION OF THE INVENTION

Figure 1:
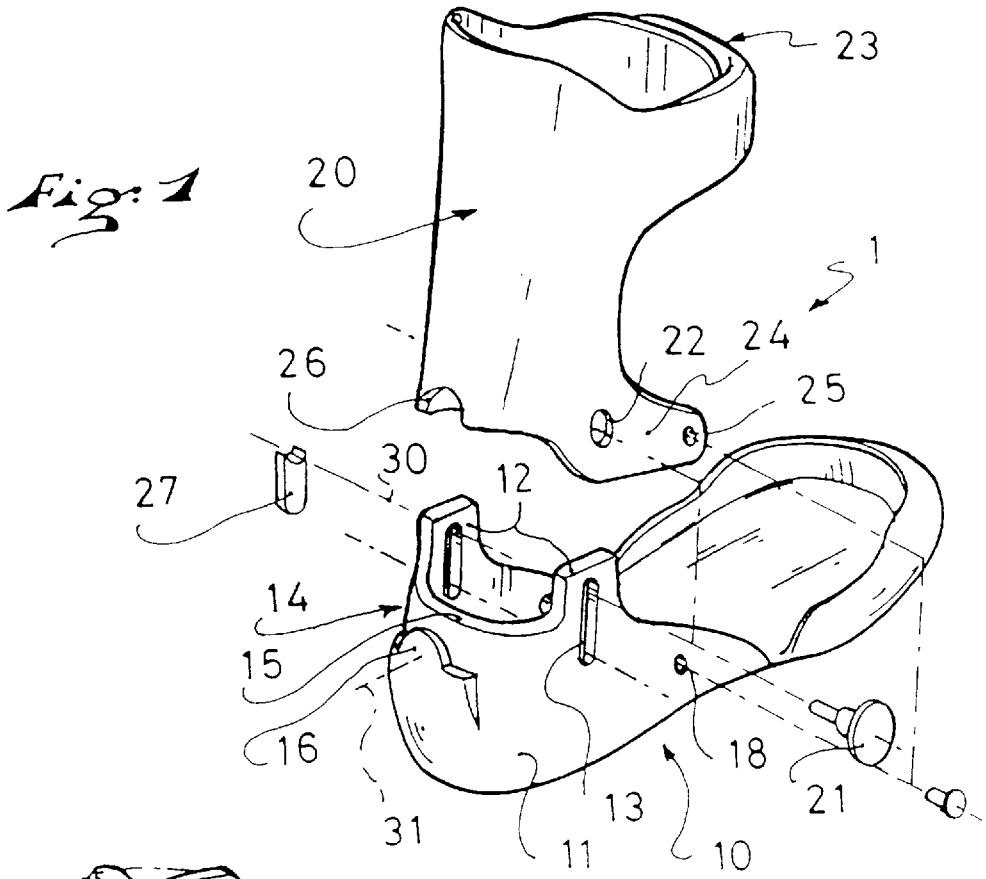
FIG. 1 is an exploded perspective view of a rigid boot frame according to a first embodiment.

The "rigid" frame 1 of the boot represented in FIG. 1 is suitable for several types of sports boots that require a good transverse retention and a good front/rear flexibility of the foot with respect to the ankle, such as skating boots, walking boots, cross-country ski boots, and snowboarding boots (surfing on snow).

In this specific case, the frame 1 is constituted of a rigid sole 10 for supporting the foot of a user, the sole being of the shell or cup type, demarcating a heel reinforcement 11 on which is journalled a rigid collar 20. The heel reinforcement 11 has, laterally, in the area of the malleoli of the foot, two extensions 12, each equipped with a substantially vertically extending elongated slot 13, and each is adapted to receive a journal element 21 of collar 20.

The rear portion 14 of the heel reinforcement 11 includes a scallop or scalloped-shaped portion 15, adapted to allow a rearward bending of the ankle without creating a hard spot for such ankle, and an abutment 16, shaped like a semicircle, projecting towards the rear, whose role is explained below.

The sole 10 can be totally rigid as represented in the drawing or it can be only partially rigid, the only rigid portion being thus constituted by the heel reinforcement 11.

The collar 20 is constituted of a cuff having a semi-cylindrical shape, open towards the front to allow the positioning of the ankle and equipped with tightening device (s) 23 of a known type and not represented in the drawings. As shown in FIG. 1, the front of the collar of the sport boot frame 1 is positioned above the instep zone of the foot, i.e., the lower edge of the front of the collar is above the instep zone. Further, it can be seen in figure that the collar is made of a single piece, i.e., a unitary member extending around the rear, sides, and front of the lower leg.

It is preferably made of a rigid synthetic material such as PEBAX.

Two holes 22 are provided laterally at the lower end of collar 20 that correspond to the slots 12 of the heel reinforcement in order to receive and anchor the journal elements 21.

At its rear lower edge, the collar 20 is equipped with a scallop 26 having a semi-circular shape and intended to cooperate with the abutment 16 of the heel reinforcement so as to provide both an rearward abutment for such collar as well as a guidance during the transverse clearances thereof.

Moreover, the collar 20 is equipped in front of its journal zone 22 with two longitudinal lateral extensions 24 adapted to be anchored at their rear end 25 or 18 on each side of the heel reinforcement 10.

These two extensions or energy tabs 24 are deformed between their two anchoring zones 22, 25 during the forward bending movements of collar 20 and, by their elastic deformation, they provide a return energy for the collar in a substantially vertical position.

The shape of collar 20 and its energy tabs 24 are determined in such a way that at rest, i.e., in the absence of any force exerted by the athlete, each of the journal elements 21 of the collar is located at the upper end of the slot 12 associated to the heel reinforcement, thus defining a transverse rotational axis or a natural bending axis towards the front 30 of collar 20 on sole 10.

Thus, in the absence of any force in the transverse direction, the collar 20 can pivot normally towards the front along the axis 30 thus defined, against the elastic mechanism constituted by the energy tabs 24.

On the other hand, the rearward bending movement of collar 20 is blocked by the cooperation of the respective abutment surfaces 26 and 16 of the collar and the sole.

If a slight rearward bending movement is desired, a slight clearance can be provided between these two abutment surfaces.

As can be readily envisioned, a transverse clearance of collar 20 with respect to the heel reinforcement 11 is rendered possible both on the inner (or medial) side as well as the outer (or lateral) side of the boot, by the vertical sliding of one of the journal elements 21 in the corresponding slot 12.

Such a clearance or transverse inclination is moreover guided by the cooperation of the circular abutment surfaces 16, 26, thus defining a sort of rotational or longitudinal bending axis 31 for the collar 20.

As can be readily envisioned, an inclination in the transverse direction of collar 20, i.e., a bending thereof with respect to the longitudinal axis 31, causes an elastic deformation of the energy tabs 24 that thus constitute a mechanism for return into the neutral position, substantially vertically with respect to the collar.

The amplitude of the transverse inclination movement of the collar is determined by the length of the slots 12 of the heel reinforcement.

If needed, the slots 12 can be designed to have different lengths between the inner side and the outer side of the boot so as to allow a greater clearance for one side of the boot when compared to the other.

The vertical slots 12 can also be provided on the collar instead of the shell, the journal elements 22 being mounted on the shell 10 so as to provide a bending about the axis 30, the slots extending upwardly in this case on the collar from the position of the axis elements.

It would also be possible to provide an abutment 27 made of an elastic material, such as rubber, at the base of each slot 12 so that the element 21 housed in the slot can be returned to the resting position.

In order to be adapted to the specific requirements of individual users, these elastic abutments 27 can be designed to be asymmetrical or have varying stiffnesses, so as to increase or decrease, as the case may be, the return energy desired in the transverse direction.

Figure 2:
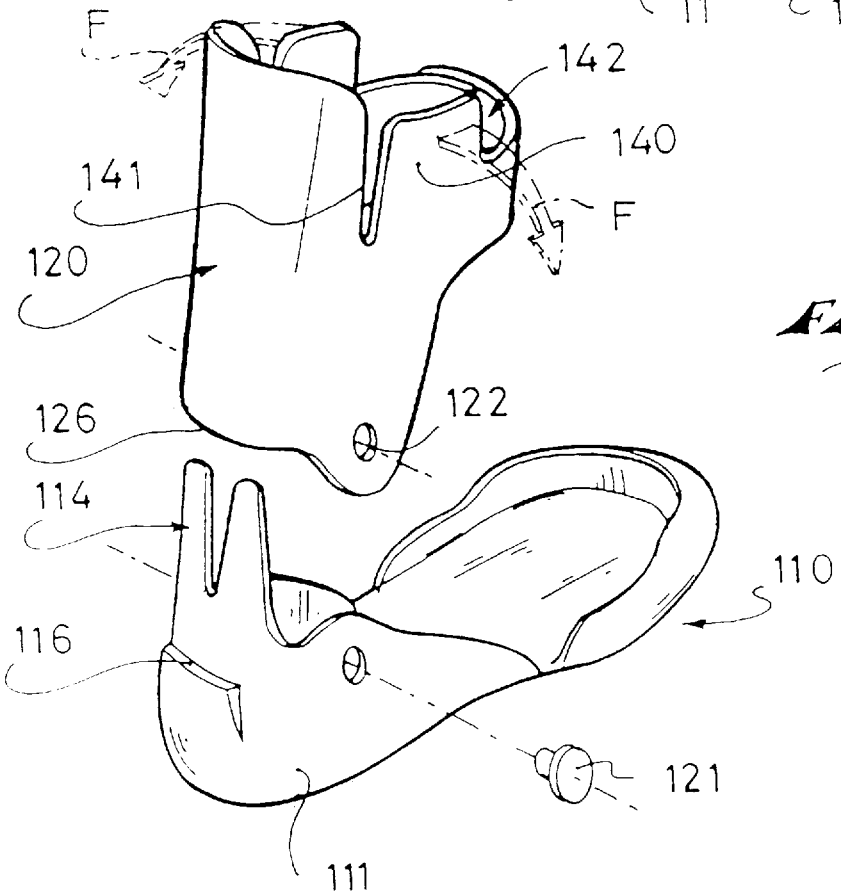
FIG. 2 is a view that is similar to FIG. 1 according to a second embodiment.

FIG. 2 illustrates a second embodiment of the invention, wherein similar or identical elements will be designated by the same references increased by 100.

In this second embodiment, the collar 120 is journalled on the reinforcement 111 by means of the lateral journal elements 121, with no possibility for any clearance in the area of these elements, and transverse clearance is provided by means of transverse deformation zones 140 provided on each side of the collar, in the area of the upper edge thereof.

Each transverse deformation zone 140 is constituted of a substantially vertical wing demarcated, on the one hand, towards the rear, via a substantially transverse slit 141 originating from the upper edge of the collar and, on the other hand, towards the front via a scallop 142.

As can be readily envisioned, the desired transverse clearance is obtained by bending and deformation of the wings 140 in the transverse direction (see arrows F). In this case, the return energy is supplied by the material of the collar 120 itself. Horizontal slits (not represented in the drawing) can be provided on the wings 140 to enable a more gradual bending of these elements.

In such an embodiment, where the transverse clearance is no longer undertaken in the area of the journal axes, but by the elastic deformation of the upper edge of collar 120, the surfaces, respectively 116, 126 of the rear abutment can be substantially planar.

In case of a forward bending of the collar 120, the return energy can be supplied by the vertical tabs 114 arranged in the rear zone of the reinforcement 111, such tabs 114 being biased and elastically deformed by the rear wall of collar 120 during the forward bending movements thereof.

Figure 3:
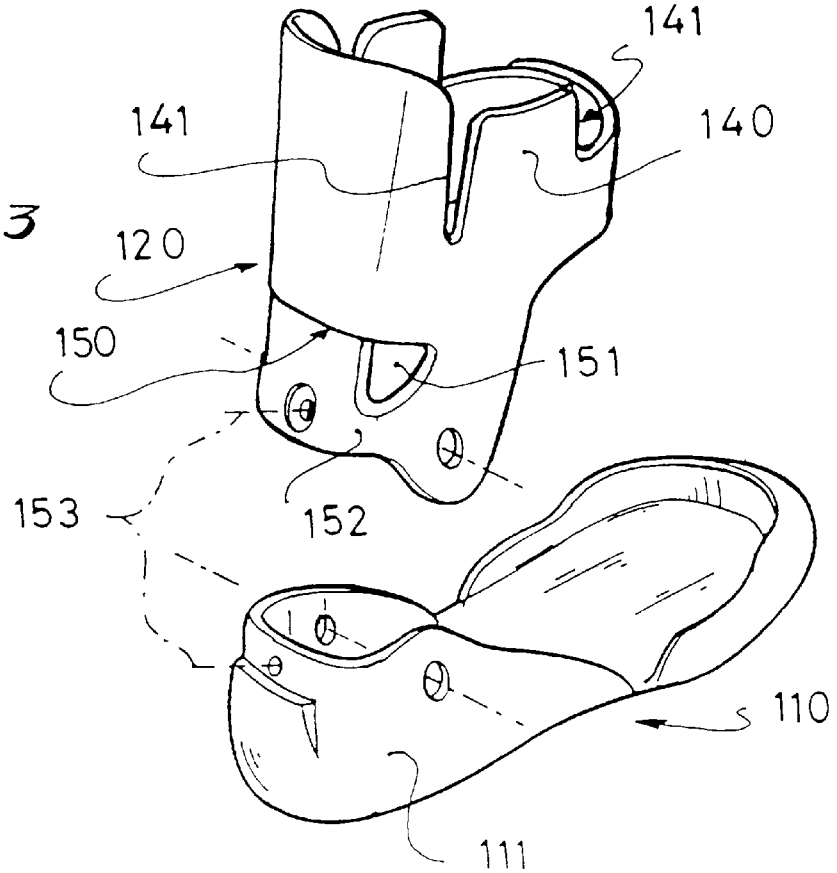
FIG. 3 is a view that is similar to FIG. 1 according to a third embodiment.

FIG. 3 represents another embodiment of the collar 120 of FIG. 2 using the principle of the elastic deformation of the upper edge of the collar, and for which the same references have been used.

The only difference lies in the energizing mode of such collar 120 in case of a forward bending. Indeed, in this case, the collar 120 is equipped at the rear with a horizontal slit 150 and two lateral scallops 151 enabling the forward bending of the collar 120 via the elastic deformation of the lateral portions 152, such elastic deformation also providing the return energy.

In this case, the rear of collar 120 is anchored at 153 on the heel reinforcement 111 so as to enable the elastic deformation of the collar during a forward bending. A projecting nipple (not represented) originating from the reinforcement 111 can be designed to cooperate with the upper edge of slit 150 and thus provide a rear support for the collar on the shell 110.

An elastic biasing system using energy tabs that are similar to the tabs 124 of the embodiment illustrated in FIG. 1 can also be envisioned.

Figure 4:
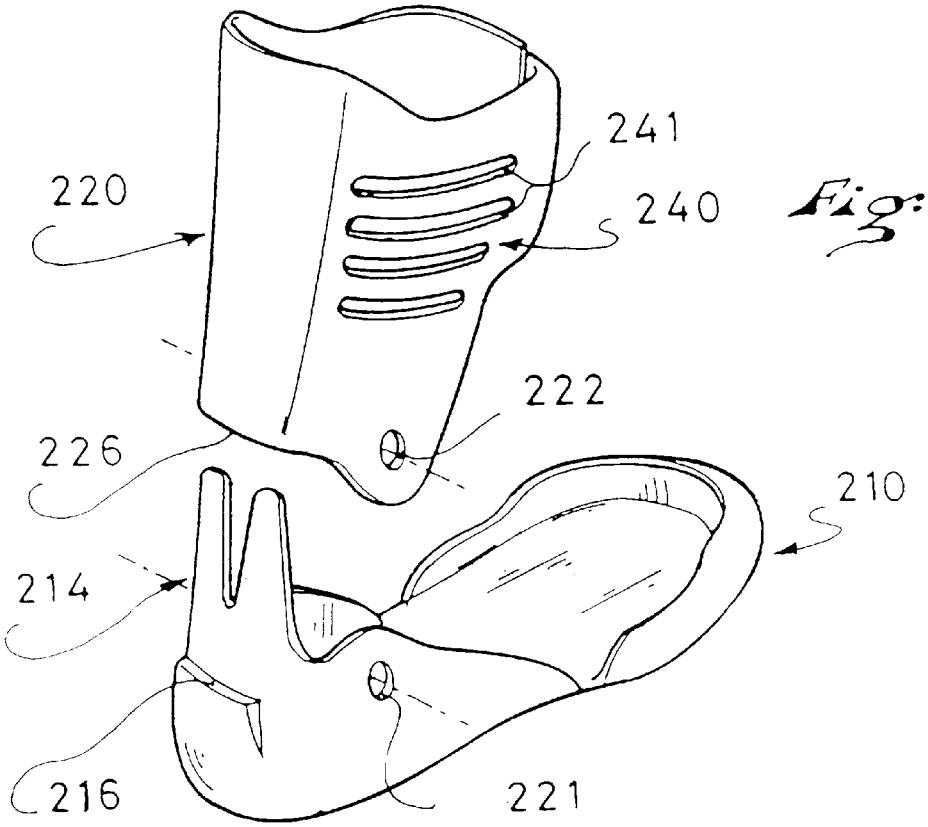
FIG. 4 is a view that is similar to FIG. 1 according to a fourth embodiment.

In the embodiment of FIG. 4, for which the same references will be used as for FIG. 2, except that they are increased by 100, the only difference with respect to FIG. 2 can be found in the construction of the transverse deformation zones 240, which here are defined by a succession of superposed lateral slits 241 oriented along a longitudinal direction on each side of the collar. These slits 241 allow the desired deformation in the transverse direction of the collar 220.

Similarly to FIGS. 2 and 3, the return energy is supplied by the elastic deformation of the material constituting the collar. Moreover, means that are more or less elastic or rigid can be provided to plug one or several slits 241, and thus modulate the deformation of the collar in the transverse direction.

Figure 5:
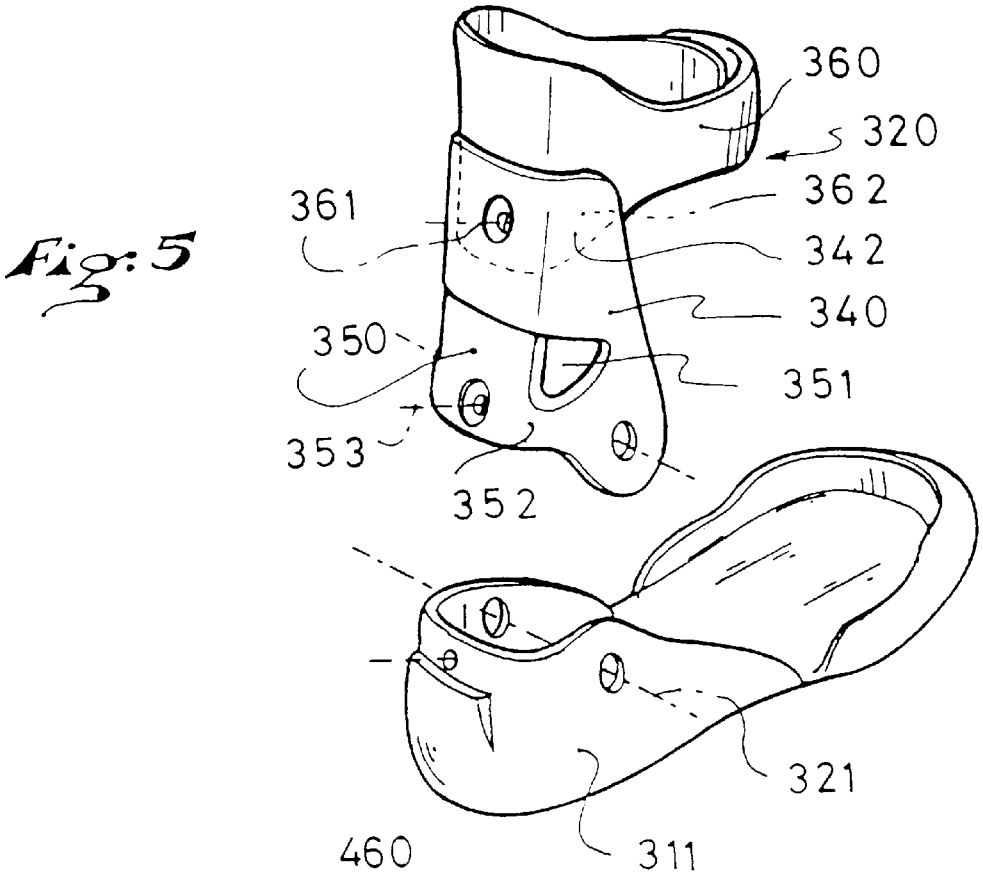
FIG. 5 is a view that is similar to FIG. 1 according to a fifth embodiment.
Figure 6:
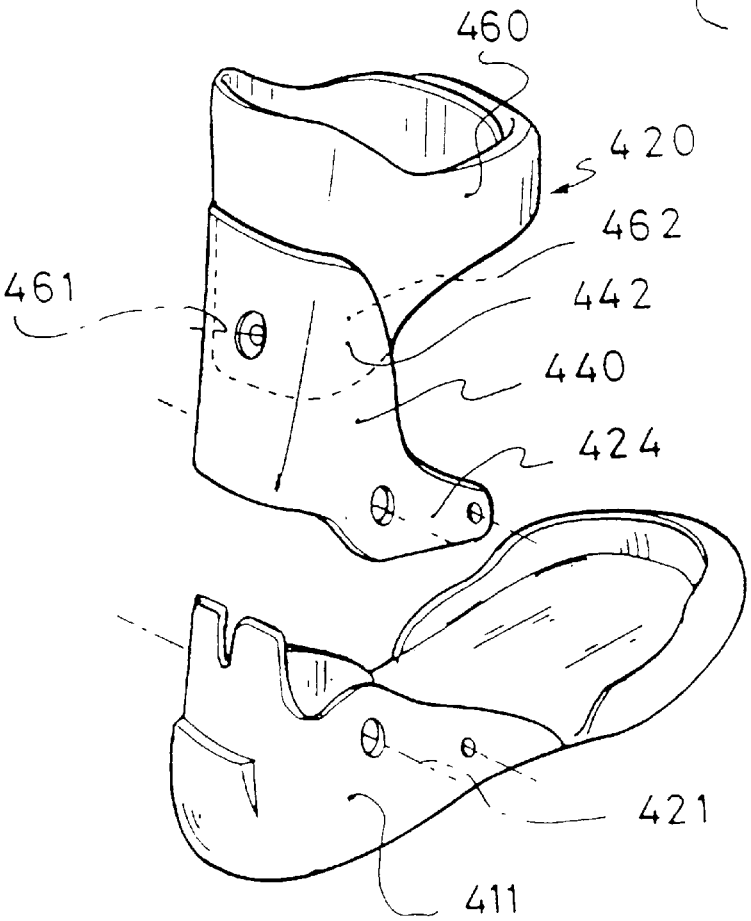
FIG. 6 is a view that is similar to FIG. 1 according to a sixth embodiment.

FIGS. 5 and 6 illustrate yet another embodiment of the collar, respectively 320, 420. In both these cases, the collar 320, 420 is made of two journalled portions that are nested in one another or, in other words, a lower portion constituting the stirrup, respectively 340, 440, and an upper portion forming a cuff, respectively 350, 450, each of them having a substantially semi-cylindrical shape.

The stirrup 340, 440 is journalled on the heel reinforcement, respectively 311, 411 by two journal elements 321, 421. In the case of FIG. 5, the stirrup is moreover anchored at 353 on the heel reinforcement 311.

In the case of FIG. 6, the return energy in forward bending is provided by two lateral energy tabs 424, as was the case in FIG. 1, whereas in the case of FIG. 5, the return energy is provided by the elastic deformation of the portions 350, 351, 352, of the stirrup portion 340 of the collar, as was the case in FIG. 3.

In order to provide the potential for transverse clearance, each cuff respectively 360, 460 of the collar is journalled on the associated stirrup, respectively 340, 440 by a longitudinal journal axis, respectively 361, 461, located at the rear of the collar.

In this case, the return mechanism in the transverse direction is constituted by the cooperation of the upper zone, respectively 342, 442, of the stirrup portion, respectively 340, 440, with the lower zone, respectively 362, 462 of the cuff, respectively 360, 460.

Indeed, these portions 342, 442, 362, 462 overlap via engaging surfaces and it is easy to envision that a lateral bending of each cuff 360, 460 about its axis 361, 461 will cause an elastic deformation of the corresponding zone, respectively 342, 442 of the stirrup.

Preferably, the portions 342, 442 are stiffened by appropriate ribs.

Figure 7:
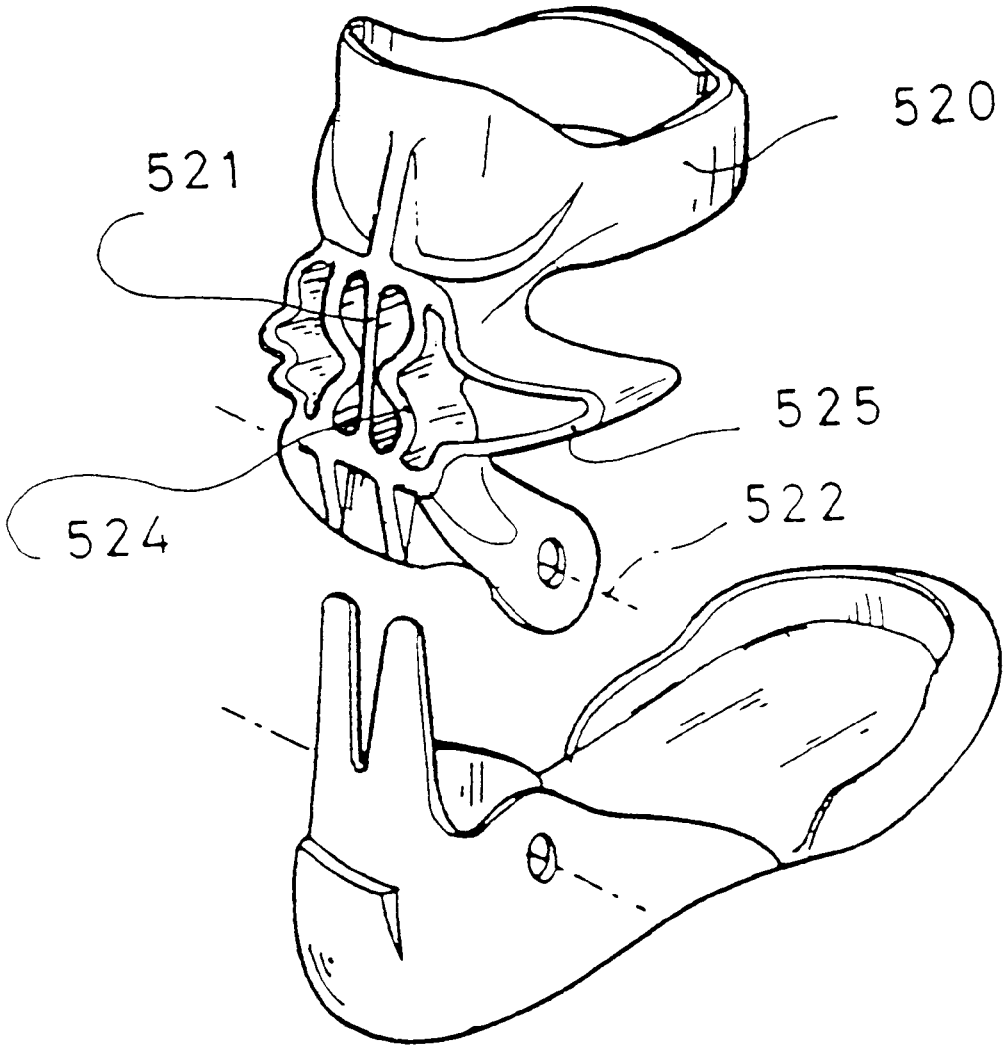
FIG. 7 is a view that is similar to FIG. 1 according to a seventh embodiment.

In the embodiment illustrated in FIG. 7, the collar 520 is journalled laterally at 522 on the heel reinforcement, similarly to the embodiments of FIGS. 2 and 3.

As was the case in FIGS. 2 and 3, the possibility for the transverse inclination and elastic return of the collar are offered by appropriate deformation zones of the collar. These zones are essentially constituted by a vertical rib 521 arranged centrally towards the rear of collar 520, and by two lateral ribs 524, 525 shaped like a more or less sharp V, essentially oriented in the horizontal direction and originating laterally from either side of the vertical rib 521.

The central rib 521 is biased elastically during the front/rear bending movements of the collar, and can thus provide the necessary return energy during these movements.

The rib 521 could potentially be used to provide the return energy in front or rear bending. In the majority of cases, it is designed to be able to bend laterally, but yet remain rigid rearwardly so as to regain force and provide a firm rear support.

In case of the transverse bending of the collar, it is essentially the lateral ribs 524, 525 that are biased instead, and that provide the necessary return energy.

An elastic device of the elastic pad type can be provided in the intervals left between the ribs, especially between the central rib 521 and the lateral ribs 524 so as to modulate the stiffness and elasticity conditions.

Figure 8:
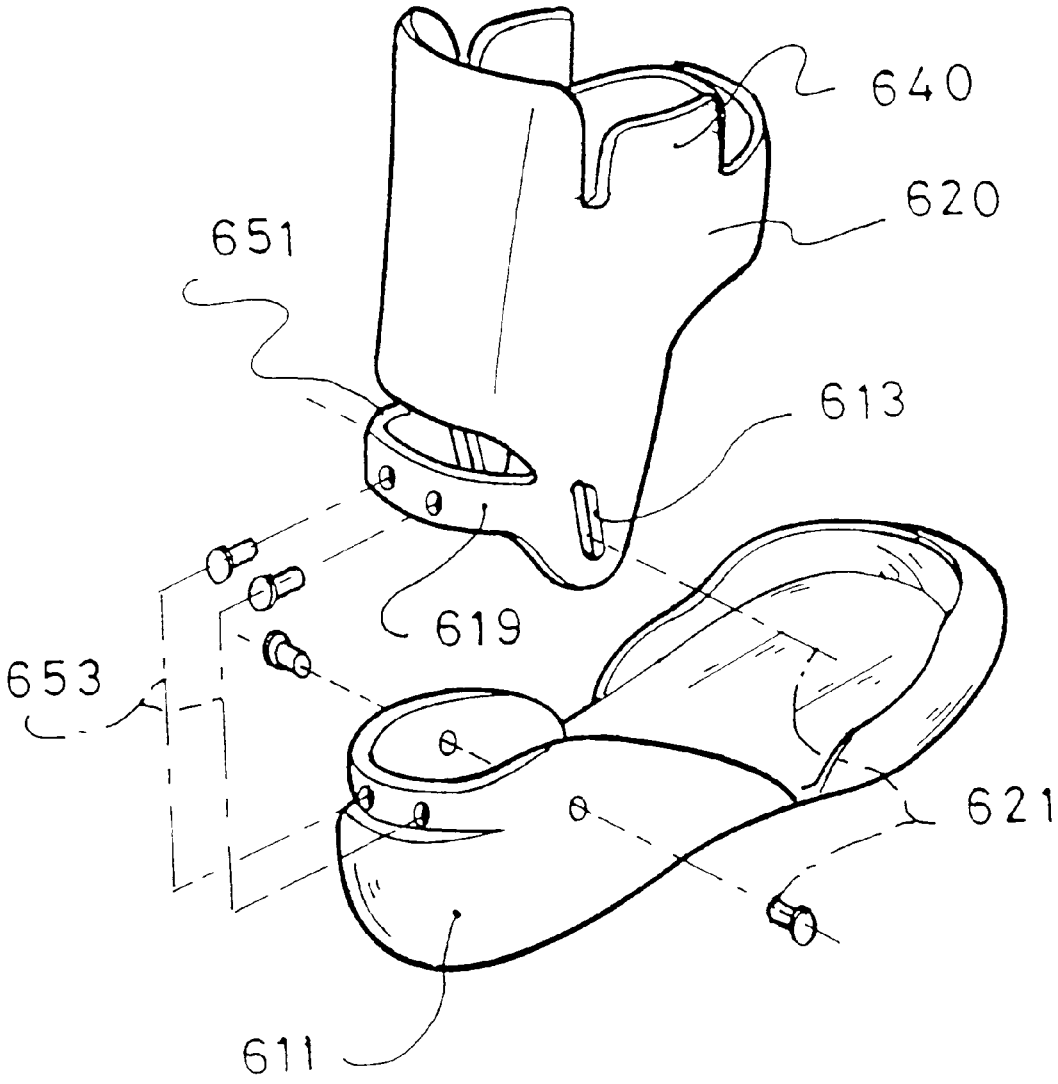
FIG. 8 is a view that is similar to FIG. 1 according to an eighth embodiment.

In the embodiment illustrated in FIG. 8, the collar 620 is anchored laterally via elements 621 on the heel reinforcement 611, and it is also fixed at the rear on the heel reinforcement at two anchoring points 653, by rivets or screws.

A transverse scallop 651, provided substantially horizontally at the rear of the collar 620, provides such collar with the possibility for forward bending by the elastic deformation of the material constituting the collar.

In addition, on each side, the collar includes an oblong slot 613, substantially inclined towards the rear, and each is adapted to receive one of the anchoring axes 621 of the collar 620. The provision of these oblong slots 613 enables a transverse inclination of the collar by the sliding of the lateral anchoring axes of the collar in the slots 613.

In this case, the return energy is provided by the deformation of the portion 619 of the collar comprised between the lateral anchoring points 613 and rear points 653. This same portion 619 also provides the return energy in case of forward bending.

Moreover, the collar 620 has, as was the case in FIG. 3, a transverse deformation zone 140 located in the area of its upper edge and capable of also being elastically deformed in the transverse direction.

The invention is not limited to the embodiments described herein. It finds a special application in all types of sports boots having similar or identical requirements.

What is claimed is:

1. A sports boot comprising:

a frame comprising a sole for supporting the foot of a user and a heel reinforcement member, said heel reinforcement member having lateral side portions and a rear portion, whereby said heel reinforcement member extends laterally along and behind a heel of the foot, at least said heel reinforcement member of said frame being rigid;

a collar made of rigid material, said collar extending upwardly from said rigid heel reinforcement member, said collar adapted to extend around a lower leg of the user, said collar including a rear portion, a pair of lateral side portions and, further, a front portion having a lower edge spaced above an instep zone of the foot and spaced above said rigid heel reinforcement member;

a forward and rearward collar movement zone between said collar and said rigid heel reinforcement member;

a transverse inclination device associated with at least each lateral side portion of said collar for facilitating transverse inclination of said collar with respect to said heel reinforcement member;

at least one elastic return arrangement provided at each lateral side of said collar for exerting an elastic return force opposing said transverse inclination of said collar.

2. A sport boot according to claim 1, wherein:

said collar has a unitary tubular configuration, whereby said rear portion, said lateral side portions, and said front portion of said collar extend unitarily around the lower leg of the user.

3. A sport boot according to claim 1, wherein:

said transverse inclination device is constituted by deformation zones located at said lateral side portions of said collar.

4. A sport boot according to claim 3, wherein:

said deformation zones comprise an uppermost part of each of said lateral side portions of said collar, said deformation zones being demarcated by a respective upwardly extending slit in each of said lateral side portions of said collar and by a forwardly positioned scallop.

5. A sport boot according to claim 3, wherein:

said deformation zones are constituted by a series of vertically spaced longitudinally extending slits in said lateral side portions of said collar.

6. A sport boot according to claim 3, wherein:

said collar further comprises a central vertical rib positioned at said rear portion of said collar; and said deformation zones are constituted by a pair of horizontally extending V-shaped lateral ribs extending from either side of said central vertical rib.

7. A sport boot according to claim 1, wherein:

at least one elastic return arrangement, provided at each lateral side of said collar, is constituted by elastic deformation of said rigid material of said collar.

8. A sport boot according to claim 2, wherein:

at least one elastic return arrangement, provided at each lateral side of said collar, is constituted by elastic deformation of said rigid material of said collar.

9. A sport boot according to claim 3, wherein:

at least one elastic return arrangement, provided at each lateral side of said collar, is constituted by elastic deformation of said rigid material of said collar.

10. A sport boot according to claim 4, wherein:

at least one elastic return arrangement, provided at each lateral side of said collar, is constituted by elastic deformation of said rigid material of said collar.

11. A sport boot according to claim 5, wherein:

at least one elastic return arrangement, provided at each lateral side of said collar, is constituted by elastic deformation of said rigid material of said collar.

12. A sport boot according to claim 6, wherein:

at least one elastic return arrangement, provided at each lateral side of said collar, is constituted by elastic deformation of said rigid material of said collar.

13. A sport boot according to claim 1, wherein:

said collar comprises two vertically overlapping parts, each having a substantially semi-cylindrical shape, said two parts being pivotally connected about a longitudinally extending journal.

14. A sport boot according to claim 1, wherein:

said collar is anchored to said heel reinforcement at said lateral side portions by means of pins extending through said collar and said heel reinforcement; and said transverse inclination device comprises upwardly extending slots within which said pins extend for enabling said transverse inclination of said collar with respect to said heel reinforcement member.

15. A sport boot according to claim 14, wherein:

said rear portion of said collar is anchored to said heel reinforcement member.

16. A sport boot comprising:

a rigid assembly comprising:

a heel reinforcement member having a rear portion and side portions for surrounding the heel of a user of the boot;

a unitary rigid collar for retaining a lower part of a leg of the user of the boot, said collar having an upper portion at least partly surrounding the leg, and lower side extensions, said side extensions being connected to said side portions of said heel reinforcement member by means of connection zones for facilitating forward movement of said collar upon a predetermined forwardly directed force exerted by the leg;

said side extensions of said collar being mounted to said side portions by a substantially vertically oriented clearance assembly allowing at least a substantial portion of said collar to move transversely upon a predetermined laterally directed force exerted by the leg;

said rigid assembly further comprising an elastic return structure acting on said substantial portion of said collar to cause said collar to return to a neutral position when said force is sufficiently lowered.

17. A sport boot according to claim 16, wherein said elastic return structure comprises:

at least a portion of said collar is fixedly attached to said heel reinforcement member, said portion being spaced apart a certain distance from said vertical clearance assembly so that at least a part of said portion is adapted to flex when the remainder of said collar is moved transversely.

18. A sport boot according to claim 17, wherein said elastic return structure further comprises:

a rear portion of said collar fixedly attached to said rear portion of said heel reinforcement member, said rear portion of said collar being separated from said substantial portion of said collar by a transverse opening.

19. A sport boot according to claim 18, wherein said rear portion of said collar is fixed at anchoring points by connections, said connections comprising at least one of rivets and screws.

20. A sport boot according to claim 16, wherein said vertical clearance assembly comprises an elongated slot provided on each side extension of said collar, each said slot being adapted to receive an anchoring member, each of said anchoring members being capable of sliding within a respective slot when said portion of said collar is moved transversely with respect to said heel reinforcement member.

21. A sports boot comprising:

a frame comprising a sole for supporting the foot of a user and a heel reinforcement member, said heel reinforcement member having lateral side portions and a rear portion, whereby said heel reinforcement member extends laterally along and behind a heel of the foot, at least said heel reinforcement member of said frame being rigid;

a collar made of rigid material, said collar extending upwardly from said rigid heel reinforcement member, said collar adapted to extend around a lower leg of the user, said collar including a rear portion, a pair of lateral side portions and, further, a front portion having a lower edge spaced above an instep zone of the foot and spaced above said rigid heel reinforcement member;

means positioned between said collar and said rigid heel reinforcement member for facilitating angular forward and rearward movement of said collar with respect to said heel reinforcement member;

a transverse inclination device associated with at least each lateral side portion of said collar for facilitating transverse inclination of said collar with respect to said heel reinforcement member;

at least one elastic return arrangement provided at each lateral side of said collar for exerting an elastic return force opposing said transverse inclination of said collar.

22. A sports boot comprising:

a frame comprising a sole for supporting the foot of a user and a heel reinforcement member, said heel reinforcement member having lateral side portions and a rear portion, whereby said heel reinforcement member extends laterally along and behind a heel of the foot, at least said heel reinforcement member of said frame being rigid;

a collar made of rigid material, said collar extending upwardly from said rigid heel reinforcement member, said collar adapted to extend around a lower leg of the user, said collar including a rear portion, a pair of lateral side portions and, further, a front portion having a lower edge spaced above an instep zone of the foot and spaced above said rigid heel reinforcement member;

a forward and rearward collar bending zone between said collar and said rigid heel reinforcement member;

a transverse inclination device associated with at least each lateral side portion of said collar for facilitating transverse inclination of said collar with respect to said heel reinforcement member;

at least one elastic return arrangement provided at each lateral side of said collar for exerting an elastic return force opposing said transverse inclination of said collar.

* * * * *